US006890222B2

(12) United States Patent
Serbin et al.

(10) Patent No.: US 6,890,222 B2
(45) Date of Patent: May 10, 2005

(54) ELECTRICAL CONNECTION

(75) Inventors: Bruce J. Serbin, Canfield, OH (US); Michael M. Fiorino, Cortland, OH (US); Kathleen D. Murphy, Girard, OH (US); Bruce S. Gump, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 35 days.

(21) Appl. No.: 10/092,984

(22) Filed: Mar. 7, 2002

(65) Prior Publication Data

US 2002/0132534 A1 Sep. 19, 2002

Related U.S. Application Data

(60) Provisional application No. 60/275,366, filed on Mar. 13, 2001.

(51) Int. Cl.[7] ..... H01R 4/10
(52) U.S. Cl. ..... 439/879; 439/891
(58) Field of Search ..... 437/877, 879, 437/891, 865, 870, 882

(56) References Cited

U.S. PATENT DOCUMENTS 3,182,282 A * 5/1965 Turner ..... 439/423
4,669,798 A * 6/1987 Daum et al. ..... 439/423
5,338,233 A * 8/1994 Endo et al. ..... 439/877
5,356,318 A * 10/1994 Fry et al. ..... 439/877
5,399,110 A 3/1995 Morello et al.
5,486,653 A * 1/1996 Dohi ..... 174/84 C
5,549,483 A * 8/1996 Hotea ..... 439/399
6,035,521 A 3/2000 Schley

* cited by examiner

*Primary Examiner*—Gary Paumen
*Assistant Examiner*—Edwin A. Leon
(74) *Attorney, Agent, or Firm*—David P. Wood

(57) ABSTRACT

An electrical connection is achieved via crimping a conventional terminal about a solid conductor. The terminal has first and second wings projecting laterally outward and in opposite directions from a base portion. An inner surface of the base portion is in electrical contact with the conductor side opposite the groove, and the outreaching wings are curled about the conductor and extend into the groove. An outer surface, opposite the inner surface, of the first and second wings engage each other within the groove to prevent spring-back of the wings out of the groove thereby assuring structural mechanical integrity of the electrical connection.

15 Claims, 4 Drawing Sheets

ELECTRICAL CONNECTION

RELATED APPLICATION

This patent application claims benefit of U.S. Provisional patent application No. 60/275,366 filed Mar. 13, 2001.

TECHNICAL FIELD OF THE INVENTION

This invention relates an electrical connection and more particularly to a solderless electrical connection having a terminal crimped to a solid core conductor.

BACKGROUND OF THE INVENTION

The crimping of terminals about a stranded wire to form a solderless electrical connection is known. A common terminal has two wings which project laterally outward and in opposite directions from one-another. The wings are wrapped about the stranded wire or cable and the distal edge of each wing is curled back into the stranded wire and crimped or embedded therein. For mechanical integrity of the connection, the terminals are made of a conductive metallic material which is harder than the conductive metallic material of the stranded wire. Typically, the harder the material the better, however, not so hard that the wings crack under stress when crimped to the stranded wire. One such material combination is a terminal made of brass and a stranded wire made of copper.

For electrical integrity of the connection, the inward surfaces of the terminal are known to have serrations designed to cut or scrub through the naturally occurring outer oxidation layer of the stranded wire which would otherwise degrade electrical continuity. To further improve electrical continuity and enhance anti-corrosion features, the copper stranded wire is often plated with tin. Although tin is prone to oxidation, it is more pliable than copper and flows easier with respect to the terminal when crimped, thereby providing a cleaner metal-to-metal contact. Unfortunately, the applications for stranded wire use is limited because of its tendency to flex creating potential shorts with nearby electrical components (i.e. circuit board) if not insulated with a non-conductive coating or rubber. Such insulated wire connections are expensive to manufacture, sensitive toward heat, and are much larger than solid core wires or male pins. These characteristics can further limit the design applications available and negatively effect feasibility.

Especially common for circuit board applications, male pins or solid core conductors or blades are preferred over stranded wires because of their reduced size and rigidity which prevents electrical shorts without having to be insulated. Unfortunately, the distal edges of the wings of the terminals do not embed within the male pin when the terminal is crimped to the male pin as they do in a stranded wire. Therefore, the wings would tend to spring-back, loosening their mechanical engagement to the male pin until the electrical continuity fails. Because of this, the mechanical and electrical engagement of a male pin to a circuit board or to a conventional terminal must include soldering or sonic welding which is labor intensive, expensive, and often requires specific metals and/or platings to secure the connection.

SUMMARY OF THE INVENTION

An electrical connection is achieved via crimping a conventional terminal about a solid conductor. The terminal has first and second wings projecting laterally outward and in opposite directions from a base portion. An inner surface of the base portion is in electrical contact with the conductor opposite the groove and the outreaching wings are curled about the conductor and extend into the groove. An outer surface, opposite the inner surface, of the first and second wings engage each other within the groove to prevent spring-back of the wings out of the groove assuring structural or mechanical integrity of the electrical connection.

Preferably, the solid conductor is compliant with respect to the terminal and is blade-like in shape. The groove is stamped into an engagement portion of the conductor producing longitudinal rails having longitudinal vertexes which impinge malleably against the inner surface of the terminal to create a clean metal-to-metal contact having reliable electrical continuity. A single metallic sheet is cut to mass produce the conductors which are configured side-by-side, and engaged unitarily to a carrier strip. The engagement portions are mass stamped while the conductors are engaged and aligned to each other via the carrier strip. The terminals are then mass crimped to the conductors. After the crimping process, the carrier strip is cut away from the conductors.

An advantage of the present invention is the ability to crimp a conventional terminal to a solid conductor without the use of welding or soldering, and which can be used in confined spaces and rigidly bent to achieve directional requirements. Another advantage is an electrical connection achievable utilizing any one of a wide variety of metallic combinations and/or platings. Yet another advantage of the invention is an electrical connection having reliable structural integrity and electrical continuity which can be produced at high volumes and at high quality and low cost.

BRIEF DESCRIPTION OF THE DRAWINGS

The present invention will now be described, by way of example, with reference to the accompanying drawings, in which.

DETAILED DESCRIPTION OF THE PREFERRED EMBODIMENTS

Figure 1:
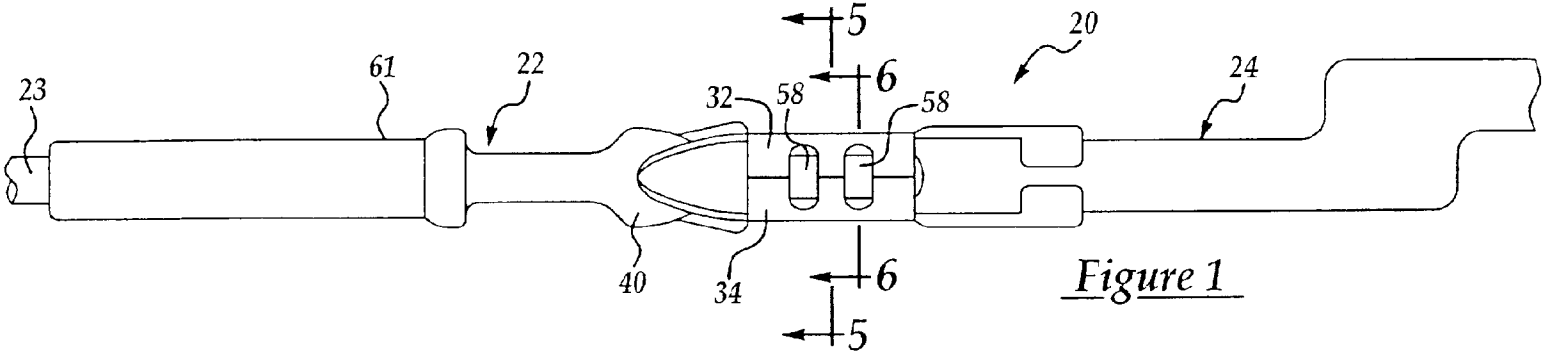
FIG. 1 a top view of an electrical connection of the present invention.
Figure 2:
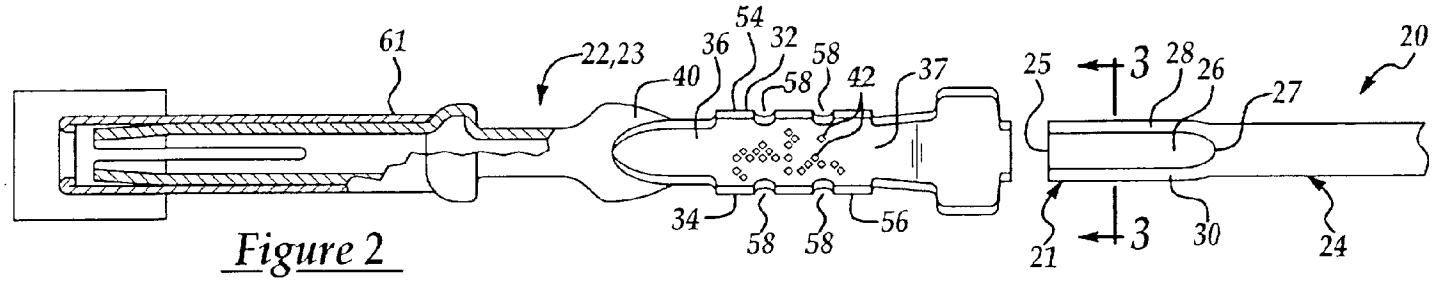
FIG. 2 is an exploded top view of the electrical connection showing a terminal in an un-crimped state.

Referring now to FIGS. 1 and 2, an electrical connection 20 is created by crimping a typical terminal 22 about the end or engagement portion 21 of an elongated solid metallic conductor or male pin 24 without the application of sonic welding or soldering. As illustrated, the solid conductor 24 projects longitudinally from one end of the terminal 22 and an insulated stranded wire 23 projects from the other end. The stranded wire 23 is engaged to the terminal 22 by crimping or any other conventional means. In turn, the opposite end of the solid conductor 24 is electrically engaged to any variety of applications including the receptacle of a circuit board, not shown. The solid conductor 24 is particularly more useful in cramped, congested or limited spaces than stranded wire because it can be bent to achieve rigid directional changes.

Figure 3:
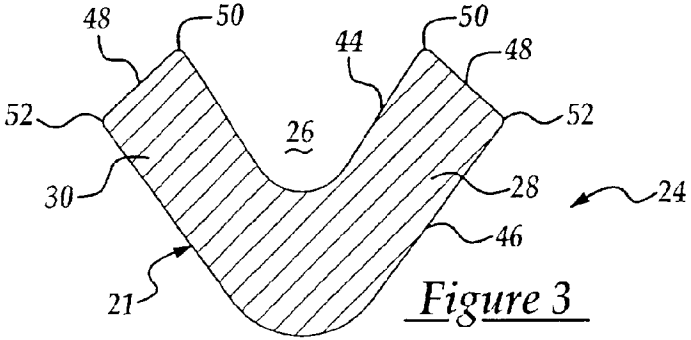
FIG. 3 is a cross section view of the terminal taken along line 3—3 viewing in the direction of the arrows of FIG. 2.
Figure 4:
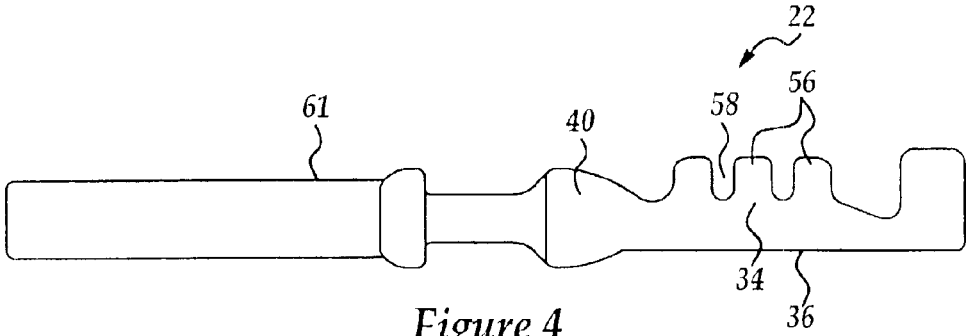
FIG. 4 is a longitudinal side view of the terminal in an un-crimped state.
Figure 5:
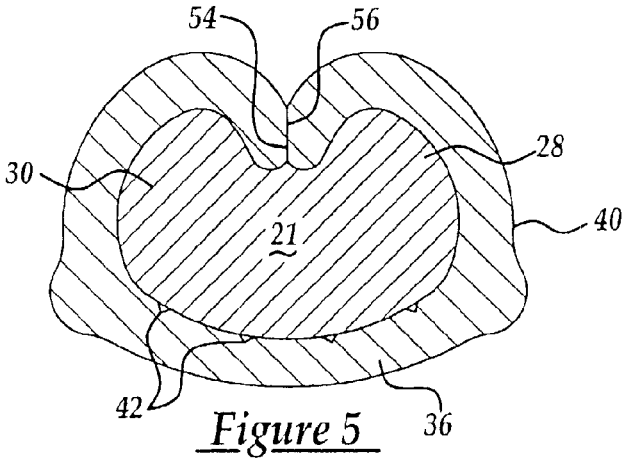
FIG. 5 is a cross section of the electrical connection taken along line 5—5 viewing in the direction of the arrows of FIG. 1.
Figure 6:
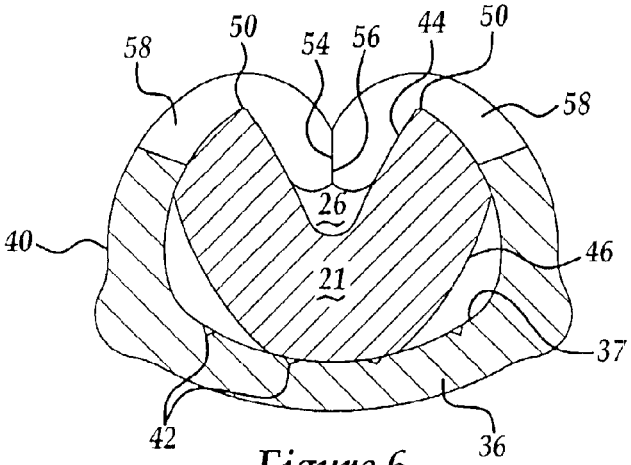
FIG. 6 is a cross section of the electrical connection taken along line 6—6 viewing in the direction of the arrows of FIG. 1.
Figure 7:
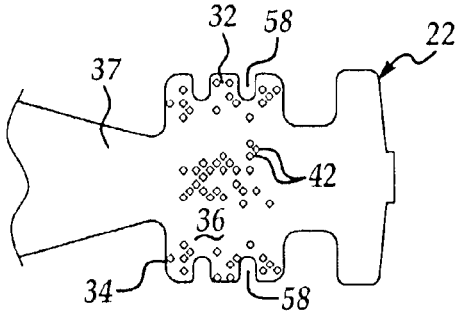
FIG. 7 is a blank view of the terminal illustrating serrations on an inner surface.

Prior to mating of the connection 20, an open ended groove or notch 26 is stamped into the substantially planar engagement portion 21 of the solid conductor 24 forming a substantially V-shaped cross section, as best shown in FIG. 3. The groove 26 extends longitudinally along the conductor 24 from an open or first end 25 to a closed or second end 27 and is defined laterally between a first rail 28 and a second rail 30 of the engagement portion 21. During the mating process of the connection 20, the engagement portion 21 of the solid conductor 24 inserts between a first wing 32 and a second wing 34 of the terminal 22 when the terminal is in an un-crimped state 23. The wings 32, 34 are then curled and crimped about respective rails 28, 30 of the engagement portion 21 of the solid conductor 24.

Referring to FIGS. 2 through 7, the wings 32, 34 of the terminal 22 project laterally outward and in opposite directions from a base portion 36 of the terminal 22. The first and second wings 32, 34 and the base portion 36 together carry an inner surface 37 and an opposite outer surface 40 of the terminal 22. A series of repeating serrations 42 are formed or stamped into the inner surface 36 and are concentrated on the wings 32, 34 and base portion 36. The serrations 42 are designed to grip or gouge into the compliant solid conductor 24 to cut or scrub through any naturally occurring surface oxidation on the conductor 24 which could otherwise degrade electrical continuity. To do this, each serration 42 has a peripheral crest or ridge which projects sharply up from the inner surface 37 and a depression which communicates into the terminal 22 and is defined circumferentially by the crest. As the crest is pushed into the compliant conductor 24 by the crimping process, the displaced conductor material is deformed plastically into the depression.

To assist in this cutting or abrasive action and plastic deformation of the compliant conductor 24, and further enhance electrical continuity, the terminal 22 is preferably made of a harder metallic material than the compliant solid conductor 24. One example of a variety of available material combinations is copper for the conductor 24 and brass for the terminal 22. However, the metallic material for the terminal 22 should not be so hard as to create stress cracks within the wings 32, 34 when they are crimped to the engagement portion 21 of the conductor 24. The solderless terminal and conductor assembly of the present invention allows for a wider variety of dissimilar metals and/or platings to suit a specific application than those metal combinations required to achieve a reliable solder or sonic weld.

The conductor 24 substantially resembles a flat bar or blade which when stamped simultaneously forms the groove 26 and the first and second rails 28, 30. The V-shaped cross section of the stamped conductor 24 is substantially dimensionally consistent throughout the longitudinally length of the groove 26. Likewise, the first rail 28 is disposed substantially parallel to the second rail 30. The engagement portion 21 of the conductor 24 is defined between a concave face 44 and a convex face 46. The groove 26 is defined by the concave face 44. Each rail 28, 30 has an edge face 48 which extends contiguously between and is disposed substantially perpendicular to the concave face 44 and the convex face 46.

Each edge face 48 of the first and second rails 28, 30 have an inner vertex 50 extended longitudinally along and directly adjacent to the groove 26 and an outer vertex 52 disposed substantially parallel to the inner vertex 50. The contiguous union of the concave face 44 to each edge face 48 of the first and second rails 28, 30 form the inner vertexes 50 and the contiguous union of the convex face 46 and the edge faces 48 of the first and second rails 28, 30 form the outer vertexes 52. Like the serrations 42 of the terminal 22, the inner and outer vertexes 50, 52 will scrub off oxidation on the inner surface 38 of the terminal 22 by slightly gouging or malleably impinging upon the inner surface 38. This scrubbing action which occurs as the rails 28, 30 deform plastically under the crimping pressure exerted externally upon the terminal 22 provides a clean metal-to-metal contact required for reliable electrical continuity of the electrical connection 20.

The structural integrity, as opposed to the electrical integrity, of the electrical connection 20 is not provided so much by the serrations 42 or the vertexes 50, 52, but is mostly provided by the intra-contact of the outer surface 40 of the terminal 22 within the groove 26. That is, the mechanical engagement portion 21 of the solid conductor 24 is assured by the contact of outer surface 40 carried by the first wing 32 to the outer surface 40 carried by the second wing 34 within the groove 26 of the conductor 24. This contact substantially extends longitudinally within the groove 26 and is focused upon a first distal edge portion 54 of the outer surface 40 carried by the first wing 32 and a second distal edge portion 56 of the outer surface 40 carried by the second wing 34. This engagement of edge portions 54, 56 prevents the wings 32, 34 from uncurling out of the groove 26 or in other words, resists spring back which would loosen the mechanical or structural integrity of the electrical connection 20 which would eventually degrade electrical continuity.

To further improve the mechanical engagement of the electrical connection 20, the first and second wings 32, 34 both have a series of windows which are disposed over the respective edge faces 48 of the first and second rails 28, 30 of the conductor 24. As the terminal 22 is crimped to the conductor 24, portions of the respective rails 28, 30 which are exposed through the windows 58 extrude or plastically deform into the windows 56. This deformation prevents the connection 20 from being pulled apart, especially along an axial direction.

Figure 8:
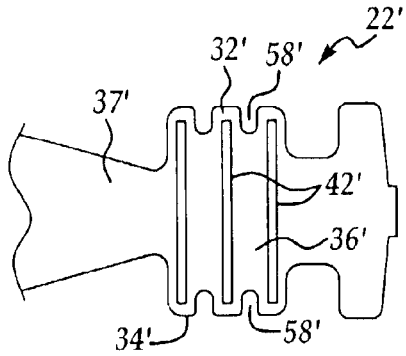
FIG. 8 is a blank view of a second embodiment of a terminal illustrating lateral ribs on an inner surface.

Referring to FIG. 8, a second embodiment of the terminal 22' is shown wherein the diamond shaped serrations 42 of the first embodiment are replaced with a series of ribs 42" which project outward from the inner surface 38' of the terminal 22'.

Figure 9:
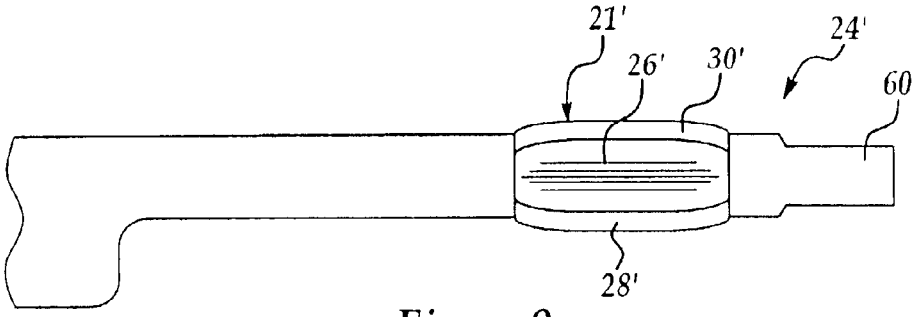
FIG. 9 is a perspective view of second embodiment of a solid conductor.

Referring to FIG. 9, a second embodiment of a solid compliant conductor 24' is shown wherein an engagement portion 21' is not disposed at the end of the conductor 24' but is stamped into the conductor at some point mid-way. Therefore, a groove 26' stamped into the engagement portion 21' is not open ended as is the groove 26 of the first embodiment. Instead of an open end, the conductor 24' has a protuberance 60 which projects axially outward from the otherwise open end of the groove 26'. If the electrical connection is encased in a non-conductive plastic coating, utilization of the compliant conductor 24' is preferred because the protuberance 60 fills or blocks a rearward port of a receptacle portion 61 of the conventional terminal 22 chosen. If this port were not blocked, the molten plastic could enter the receptacle portion 61 which would prevent the conventional terminal 22 from mating with the second conductor or male pin 23 at its opposite end. Of course, whether a protuberance 60 is needed or not is dependent upon the type of convention terminal chosen. The ultimate point being, the engagement portion need not be at the end of the conductor.

Figure 10:
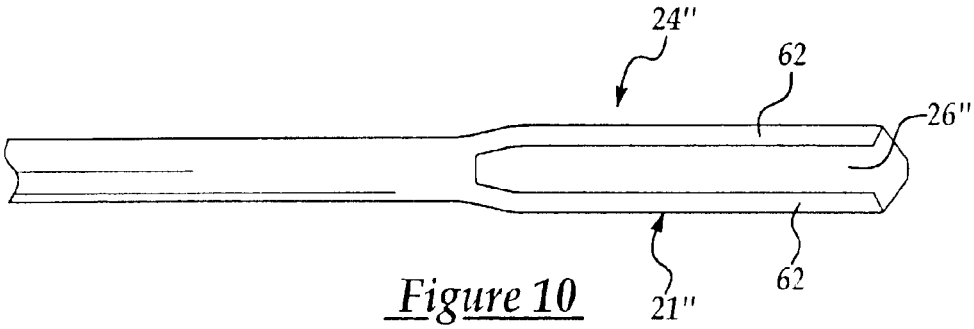
FIG. 10 is a perspective view of a third embodiment of the solid conductor.

Referring to FIG. 10, a third embodiment of the conductor 24" is shown wherein the conductor is a solid rod or pin. Stamping or imprinting of this rod to form the groove 26" creates a cross section that is generally U-shaped. The cylindrical male pin 24" has a convex face 46" which forms contiguously into a concave face 44". The union of the two faces forms a single vertex 62 on either side of the groove 26".

Figure 11:
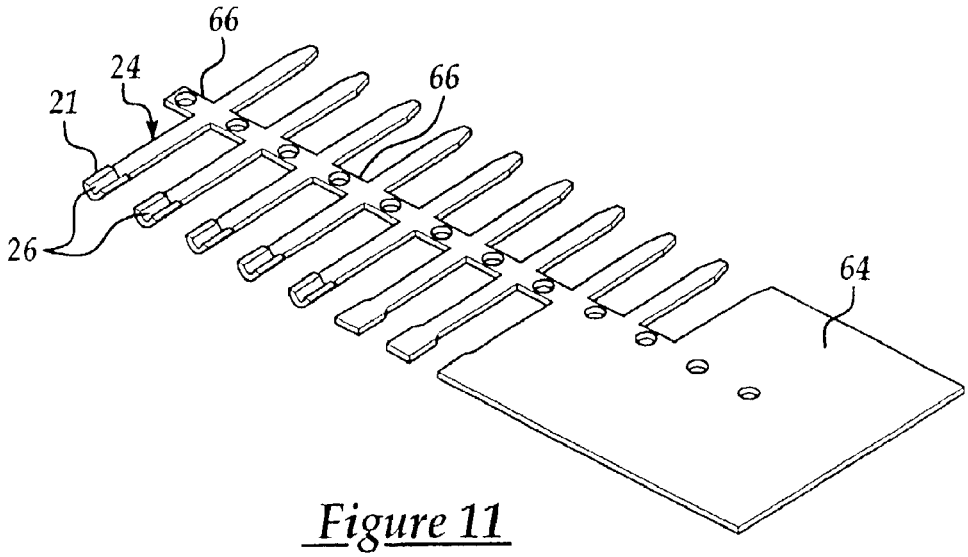
FIG. 11 is a perspective view of a series of the first embodiment of the terminals unitarily engaged to a carrier strip.

As best illustrated in FIG. 11, the blade-like conductors 24 can be manufactured at high volumes utilizing a sheet or roll of metallic material 64. The metallic sheet 64 is stamped or cut to produce a series of solid conductors 24 spaced equally apart side-by-side and formed together as a unitary piece by a carrier strip 66. The ends of each conductor 24 are then mass stamped (i.e. high volume, automated process) to form the engagement portions 21. While the conductors 24 are still connected together as a unitarily piece by the carrier strip 66, the terminals 22 are crimped to the engagement portion 23 of the solid conductors 24. After the crimping process, the carrier strip 66 is cut away producing the electrical connection 20. This high volume, automated process reduces labor costs and improves quality.

Figure 12:
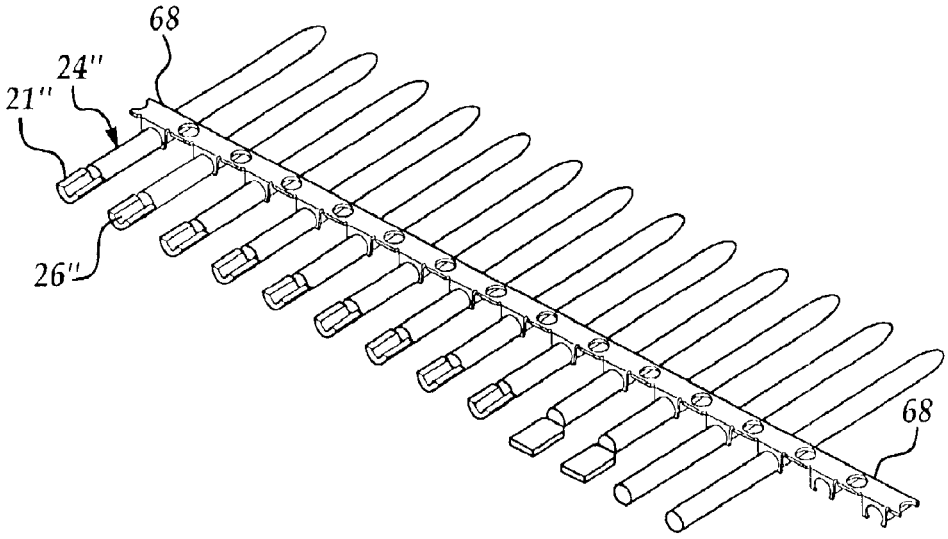
FIG. 12 is a perspective view of a series of the third embodiment of the terminals press fitted to a bondoliered carrier strip.

Referring to FIG. 12, a similar mass production process can be performed for the cylindrical conductors 24" except that a bondoliered carrier strip 68 is used which is not unitary to the conductors 24". Instead, the unstamped conductors 24" are press fitted, side-by-side into the carrier strip 68. The conductors 24" are then mass stamped producing an engagement portion 21". However, the carrier strip 66 is less likely to create quality problems as a result of misalignment between the uncrimped terminal and the conductor because the cylindrical conductor 24" may rotate slightly with respect to the carrier strip 68 whereas the flat conductor 24 can not rotate with respect to the unitary carrier strip 66.

While the forms of the invention herein disclosed constitute presently preferred embodiments, many others are possible. It is not limited herein to mention all the possible equivalent forms or ramifications of the invention. It is understood that the terms used herein are merely descriptive rather than limiting and that various changes may be made without departing from the spirit or scope of the invention.

What is claimed is:

1. An electrical connection comprising:

an elongated solid conductor having a longitudinally extending groove; and a terminal having a base portion, a first wing and a second wing, the base portion engaging the solid conductor, the first and second wings projecting laterally outward and in opposite directions from the base portion, the first wing and the second wing curling about the solid conductor and projecting into the groove, the first wing and the second wing engaging each other within the groove to resist spring-back of the first and second wings, an outer surface of the terminal carried by the base portion, the first wing and the second wing; and the outer surface having a first distal edge portion carried by the first wing and disposed within the groove and a second distal edge portion carried by the second wing and disposed within the groove, the first and second distal edge portions being engaged to prevent spring-back of the first and second wings out of the groove, the solid conductor have a compliant first rail and a compliant second rail, the groove being defined laterally between the first and second rails;

a window carried by the first wing, wherein the compliant first rail of the conductor extrudes into the window of the first wing when the terminal is curled and crimped about the conductor; and a window carried by the second wing, wherein the compliant second rail of the conductor extrudes into the window of the second wing when the terminal is curled and crimped about the conductor.

2. The electrical connection set forth in claim 1 wherein the first and second rails each have a longitudinally extending vertex impinged malleably against the respective first and second wings of the terminal when the terminal is curled and crimped about the conductor providing electrical engagement of the terminal to the conductor.

3. An electrical connection comprising:

a male pin having a longitudinally extending groove, a concave face defining the groove, and a convex face aligned laterally outward from the concave face;

a terminal having an outer surface, an inner surface, a first wing and an opposite laterally extending second wing;

the outer surface of the crimp terminal having a first distal edge portion carried by the first wing and a second distal edge portion carried by the second wing;

wherein the inner surface of the crimp terminal is engaged electrically to the male pin when the crimp terminal is curled and crimped about the male pin;

wherein the first and second distal edge portions of the first and second wings are disposed within the groove and extended longitudinally with respect to the male pin, the first distal edge portion being engaged to the second distal edge portion, a compliant first rail of the male pin defined between the convex and concave faces;

a compliant second rail of the male pin defined between the convex and concave faces, the groove extending longitudinally between the first and second rails;

a window carried by the first wing wherein the compliant first rail of the male pin extrudes outward and into the window of the first wing when the crimp terminal is crimped about the male pin; and a window carried by the second wing wherein the compliant second rail of the male pin extrudes outward and into the window of the second wing when the crimp terminal is crimped about the male pin.

4. The electrical connection set forth in claim 3 wherein the first and second rails each have a vertex extended axially to the male pin and wherein the vertexes cut into the inner surface of the respective first and second wings when the crimp terminal is being crimped about the first and second rails of the male pin.

5. The electrical connection set forth in claim 4 wherein the crimp terminal is harder than the male pin.

6. The electrical connection set forth in claim 5 wherein the male pin is cylindrical and has a U-shaped cross section aligned axially to the groove.

7. The electrical solid core crimp connection set forth in claim 5 wherein the first and second rails each have a leading end and a trailing end, and wherein the groove communicates through the leading end and the solid core male pin projects rearward from the trailing end.

8. The electrical connection set forth in claim 5 wherein the male pin has a V-shaped cross section aligned axially to the groove.

9. The electrical connection set forth in claim 8 wherein the male pin is a planar bar.

10. The electrical connection set forth in claim 9 comprising:

the groove having a leading end and a trailing end each carried by both the first and second rails; and a protuberance projecting axially forward from the leading end, and the male pin projecting rearward from the trailing end.

11. A method of making an electrical connection comprising:

providing an elongated solid conductor of one piece construction having a longitudinally extending groove;

providing a terminal having at one end a base portion, a first wing and a second wing that project laterally outward and in opposite directions from the base portion and at an opposite end a portion for mating with a second conductor, engaging the base portion with the solid conductor, curling the first wing and the second wing solely about the solid conductor of one piece construction so that the ends of the first wing and the second wing project into the groove and engage each other within the groove to resist spring-back of the first and second wings.

12. An electrical connection comprising:

an elongated solid conductor having a longitudinally extending groove;

a terminal having at one end a base portion, a first wing and a second wing, the base portion engaging the solid conductor, the first and second wings projecting laterally outward and in opposite directions from the base portion, the first wing and the second wing curling about the solid conductor and projecting into the groove, the first wing and the second wing engaging each other within the groove to resist spring-back of the first and second wings, the terminal having a portion at the opposite end for mating with another conductor, the elongated solid conductor being of one piece construction, and the first wing and the second wing curling solely about the elongated solid conductor of one piece construction.

13. The electrical connection as defined in claim 12 wherein the elongated solid conductor has a portion with a V-shaped cross section that provides the longitudinally extending groove.

14. The electrical connection set forth in claim 12 comprising:

an outer surface of the terminal carried by the base portion, the first wing and the second wing; and the outer surface having a first distal edge portion carried by the first wing and disposed within the groove and a second distal edge portion carried by the second wing and disposed within the groove, the first and second distal edge portions being engaged to prevent spring-back of the first and second wings out of the groove.

15. An electrical connection comprising:

an elongated solid conductor having a longitudinally extending groove;

a terminal having at one end a base portion, a first wing and a second wing, the base portion engaging the solid conductor, the first and second wings projecting laterally outward and in opposite directions from the base portion, the first wing and the second wing curling about the solid conductor and projecting into the groove, the first wing and the second wing engaging each other within the groove to resist spring-back of the first and second wings, the terminal having a portion at the opposite end for mating with another conductor, the elongated solid conductor being of one piece construction, the first wing and the second wing curling solely about the elongated solid conductor of one piece construction, the elongated solid conductor having a portion with a V-shaped cross section that provides the longitudinally extending groove the portion with a V-shaped cross section having a first rail and a second rail, and the first wing and the second wing curling about the first rail and the second rail respectively.

* * * * *